US007231971B2

(12) United States Patent
McCalvin

(10) Patent No.: US 7,231,971 B2
(45) Date of Patent: Jun. 19, 2007

(54) DOWNHOLE SAFETY VALVE ASSEMBLY HAVING SENSING CAPABILITIES

(75) Inventor: David E. McCalvin, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 329 days.

(21) Appl. No.: 10/711,872

(22) Filed: Oct. 11, 2004

(65) Prior Publication Data

US 2006/0076149 A1 Apr. 13, 2006

(51) Int. Cl.
*E21B 34/10* (2006.01)

(52) U.S. Cl. ..... 166/250.01; 166/375; 166/332.8

(58) Field of Classification Search ..... 166/250.01, 166/250.07, 374, 375, 332.8
See application file for complete search history.

(56) References Cited

U.S. PATENT DOCUMENTS 3,731,742 A * 5/1973 Sizer et al. ..... 166/375
3,833,060 A * 9/1974 Craggs et al. ..... 166/68
4,649,993 A 3/1987 Going, III
4,706,933 A * 11/1987 Sukup et al. ..... 251/54
5,008,664 A 4/1991 More et al.
5,526,883 A * 6/1996 Breaux ..... 166/373
5,706,892 A 1/1998 Aeschbacher, Jr. et al.
5,868,201 A 2/1999 Bussear et al.
5,875,852 A 3/1999 Floyd et al.
6,199,629 B1 3/2001 Shirk et al.
6,269,874 B1 * 8/2001 Rawson et al. ..... 166/53
6,435,282 B1 * 8/2002 Robison et al. ..... 166/386

FOREIGN PATENT DOCUMENTS

GB 2330598 4/1999
GB 2337065 11/1999

* cited by examiner

*Primary Examiner*—William Neuder
(74) *Attorney, Agent, or Firm*—Robert A Van Someren; Dona C. Edwards; Bryan P. Galloway

(57) ABSTRACT

An apparatus that is usable with a subterranean well includes a safety valve assembly and a pressure/temperature sensor. The safety valve assembly is controllable to selectively isolate a formation of a well from the surface of the well. The pressure/temperature sensor is located in the safety valve assembly to measure a pressure/temperature near the safety valve assembly.

61 Claims, 5 Drawing Sheets

DOWNHOLE SAFETY VALVE ASSEMBLY HAVING SENSING CAPABILITIES

BACKGROUND

The invention relates generally to a downhole safety valve assembly that has sensing capabilities, such as, for example, a safety valve assembly that has at least one temperature and/or pressure sensor.

A typical subterranean well includes a formation isolation valve, or safety valve, for purposes of providing a failsafe mechanism to isolate one or more downhole formations from the surface of the well. A typical safety valve may be formed from a flapper element that is located inside a tubular string and is biased to close off a central passageway of the string. The flapper element may be opened by a flow tube.

More specifically, a conventional safety valve assembly may include a flapper valve element and a hydraulically-actuated flow tube. When communication is desired between the surface and the formation(s) below the safety valve, the flow tube is actuated to force the flapper valve element open. However, when this communication is no longer desired, the flow tube is actuated to retract, a retraction that allows the flapper element to return to its normally closed position to isolate the formation(s) from the surface of the well.

A difficulty in using the above-described arrangement is that downhole seals, such as seals associated with hydraulic control lines that control movement of the flow tube, may potentially fail. Although safety valve assemblies have been designed to accommodate potential seal failure, an operator at the surface of the well may be unaware of such a failure or the specific type of failure, as the safety valve assembly typically is located far (approximately 10,000 feet or more downhole, for example) from the surface of the well.

SUMMARY

In an embodiment of the invention, an apparatus that is usable with a subterranean well includes a safety valve assembly and a pressure sensor. The safety valve assembly is controllable to selectively isolate a formation of the well from the surface of the well. The pressure sensor is located in the safety valve assembly to measure a pressure near the safety valve assembly.

In another embodiment of the invention, an apparatus that is usable with a subterranean well includes a safety valve assembly and a temperature sensor. The safety valve assembly is controllable to selectively isolate a formation of the well from the surface of the well. The temperature sensor is located in the safety valve assembly to measure a temperature near the safety valve assembly.

Advantages and other features of the invention will become apparent from the following description, drawing and claims.

DETAILED DESCRIPTION

Figure 1:
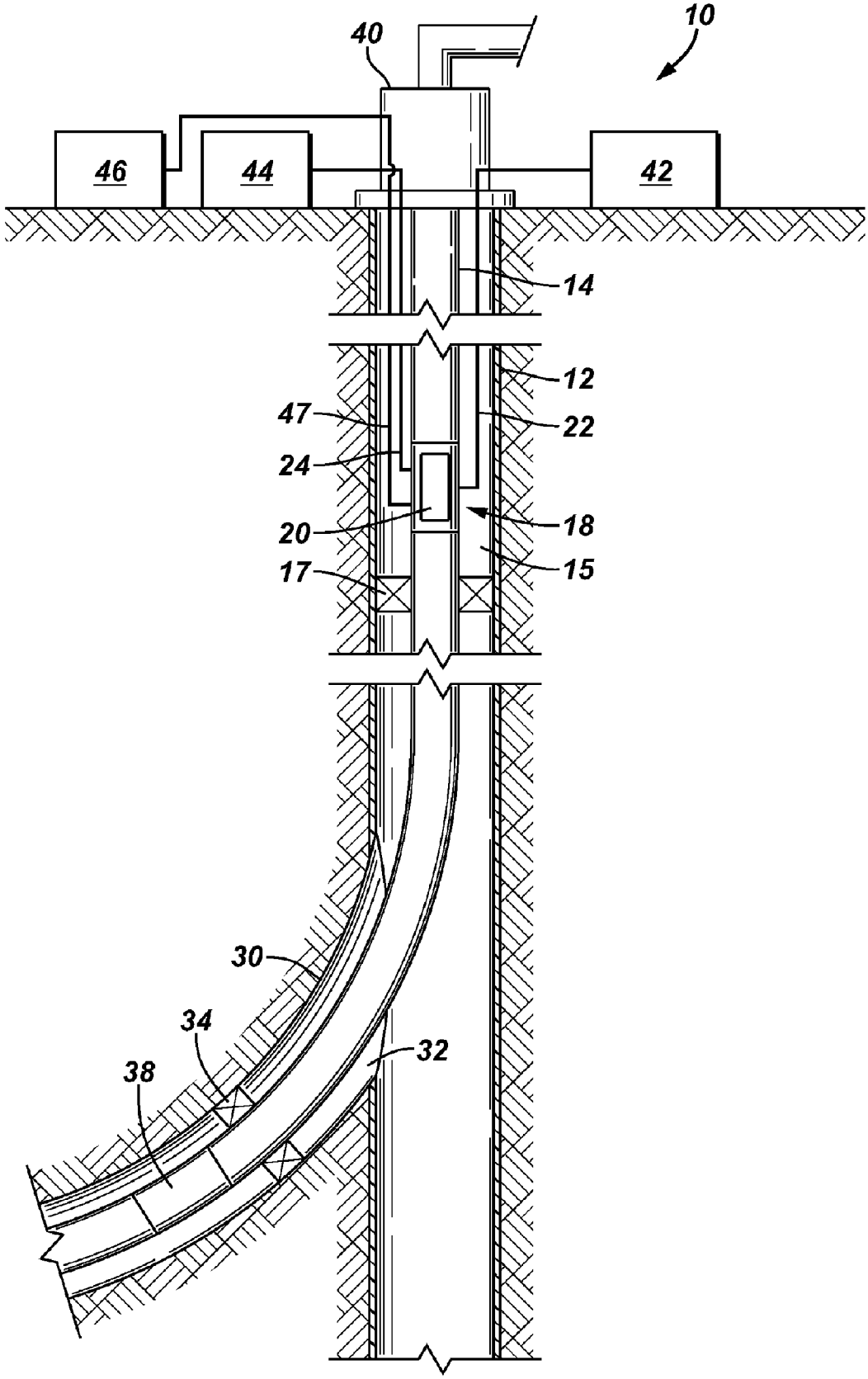
FIG. 1 is a schematic diagram of a well according to an embodiment of the invention.

Referring to FIG. 1, an embodiment of a subterranean well 10 in accordance with the invention includes a tubular string, such as a production tubing string 14, that extends downhole into the well 10. As depicted in FIG. 1, in some embodiments of the invention, the well 10 may be cased, and thus, the production tubing string 14 may extend downhole inside a casing string 12 that lines a borehole of the well 10.

The tubing string 14 includes a safety valve assembly 18 that may be remotely operated from the surface of the well 10 for purposes of selectively isolating one or more formations below the valve 18 from the surface of the well 10. In some embodiments of the invention, the safety valve assembly 18 may be located miles (more specifically, 5,000-10,000 feet or more, for example) from the surface of the well 10. Due to this distance from the surface, an operator of the well 10 may only speculate as to the condition of the well at the depth of the safety valve assembly 18, if not for the features of the present invention.

More specifically, in accordance with an embodiment of the invention, the safety valve assembly 18 includes one or more pressure sensors 20 that are integrated into the safety valve assembly 18 and are constructed to measure various pressures downhole. For example, in some embodiments of the invention, some of the pressure sensors 20 may measure pressures connected with hydraulic control lines 22 and 24 that are used to operate the safety valve assembly 18.

As another example, in some embodiments of the invention, one or more of the pressure sensors 20 may measure a pressure present in an annulus 15 of the well 20. As used herein, the term "annulus" means the region of the well that surrounds the tubing string 14 and is generally defined between the outer region surrounding the safety valve assembly 18 and the interior wall of the casing string 12 (assuming the well 10 is cased).

As yet another example, in some embodiments of the invention, one or more of the pressure sensors 20 may measure the pressure of fluid flowing through a central passageway, of the tubing string 14. Thus, the safety valve assembly 18 contains one or more pressure sensors 20 that allow an operator at the surface of the well 20 to monitor potentially many different fluid pressures at the depth of the safety valve assembly 18.

As depicted in FIG. 1, in some embodiments of the invention, the safety valve assembly 18 may communicate the measure pressure(s) with a monitoring circuit 46 that is located at the surface (surface may refer to a sea floor mounted system) of the well 10. The monitoring circuit 46 may, for example, display the measured pressure(s), further process the measured pressure(s) and/or communicate the measured pressures to another location, as just a few examples.

The communication between the monitoring circuit 46 and the pressure sensor(s) 20 may occur, for example, via one or more telemetry lines 47 that extend between the safety valve assembly 18 and the surface of the well 10. However, in other embodiments of the invention, other telemetry techniques may be used for purposes of establishing communication between the pressure sensors 20 and the monitoring circuit 46.

For example, depending on the particular embodiment of the invention, electromagnetic communication (via formation-communicated waves or waves communicated via the production tubing string 14 or casing string 20, for example); fluid pulse communication (via fluid in the annulus 15 or fluid in a column of fluid present in a control passageway of the production tubing string 14, for example); or acoustic communication (communication via the well of the production tubing string 14, for example) may be used. Thus, many different telemetry techniques may be used to communicate the measured pressure(s) between the sensor(s) 20 of the safety valve assembly 18 and the monitoring circuit 46, in accordance with the many possible embodiments of the invention.

In some embodiments of the invention, the state (open or closed) of the safety valve assembly 18 may be controlled by the hydraulic control lines 22 and 24. More specifically, the hydraulic control line 22 communicates hydraulic fluid between the surface of the well 10 and the safety valve assembly 18. As described below, the hydraulic fluid in the hydraulic control line 22 exerts a control pressure (called $P_c$) that, when at the appropriate level (relative to a $P_b$ balance pressure described below), places the safety valve assembly 18 in its open state. The control pressure $P_c$ is controlled by a hydraulic source 42 that is located at the surface of the well 10, for example.

The hydraulic control line 24 also communicates hydraulic fluid between the surface of the well 10 and the safety valve assembly 18. As described below, the hydraulic fluid in the hydraulic control line 24 exerts a balance pressure (called $P_b$). The balance pressure $P_b$ is exerted (and thus, is controlled by) a hydraulic source 44 that is located at the surface of the well 10.

The open and closed states of the safety valve assembly 18 are controlled by the $P_b$ and $P_c$ pressures. More specifically, when the $P_c$ control pressure exceeds the $P_b$ balance pressure by a certain threshold, the safety valve assembly 18 is placed in its open state. Otherwise, the safety valve assembly 18 is in its closed state.

As further described below, in some embodiments of the invention, the safety valve assembly 18 may have various failsafe aspects to accommodate the scenario in the control hydraulics for the valve assembly 18 fail. In other words, these failsafe aspects ensure that the safety valve assembly 18 is closed if one or more seals of the safety valve or control system assembly 18 should fail.

Still referring to FIG. 1, among the other features of the well 10, in some embodiments of the invention, a wellhead 40 may be coupled to the upper end of the production tubing string 14 for purposes of directing well fluid from the string 14 to a pipeline, well processing equipment, etc. Furthermore, in some embodiments of the invention, the well 10 may include one or more lateral wellbores, such as a lateral wellbore 32 in which a horizontal liner 30 laterally extends from the casing string 12.

Thus, as depicted in FIG. 1, in some embodiments of the invention, the production tubing string 14 may extend into this lateral wellbore and may include, for example, a "smart" production control valve 38 that includes sensors and at least one valve for purposes of controlling production from the associated zone. As depicted in FIG. 1, in some embodiments of the invention, this zone may be created via a packer 34 that seals off an annulus between the string 14 and the corresponding liner 30.

In some embodiments of the invention, the well 10 may include additional packers, such as, for example, a packer 17 that is located near the safety control valve assembly 18.

Integrating pressure measurements with the safety valve assembly 18 provides real data to the surface of the well 10 to enhance the operator's ability to "know-the-well." Thus, the collection of the pressure data at the surface of the well aids in selecting well operations for enhanced production, as well as providing knowledge as to the operation of the hydraulics at the safety valve setting depth location. The use of this technique greatly simplifies the typical "guess work" of troubleshooting well performance properties, by providing valid in-the-well-data upon which decisions may be based. Additionally, the ability to measure the pressures above and below the closure mechanism offers better controls over the application of pressures to equalize the loading on the closure mechanism to allow free movement of the closure thereby minimizing the forces required for this action. Therefore, the time and cost of such operations are minimized.

Figure 2:
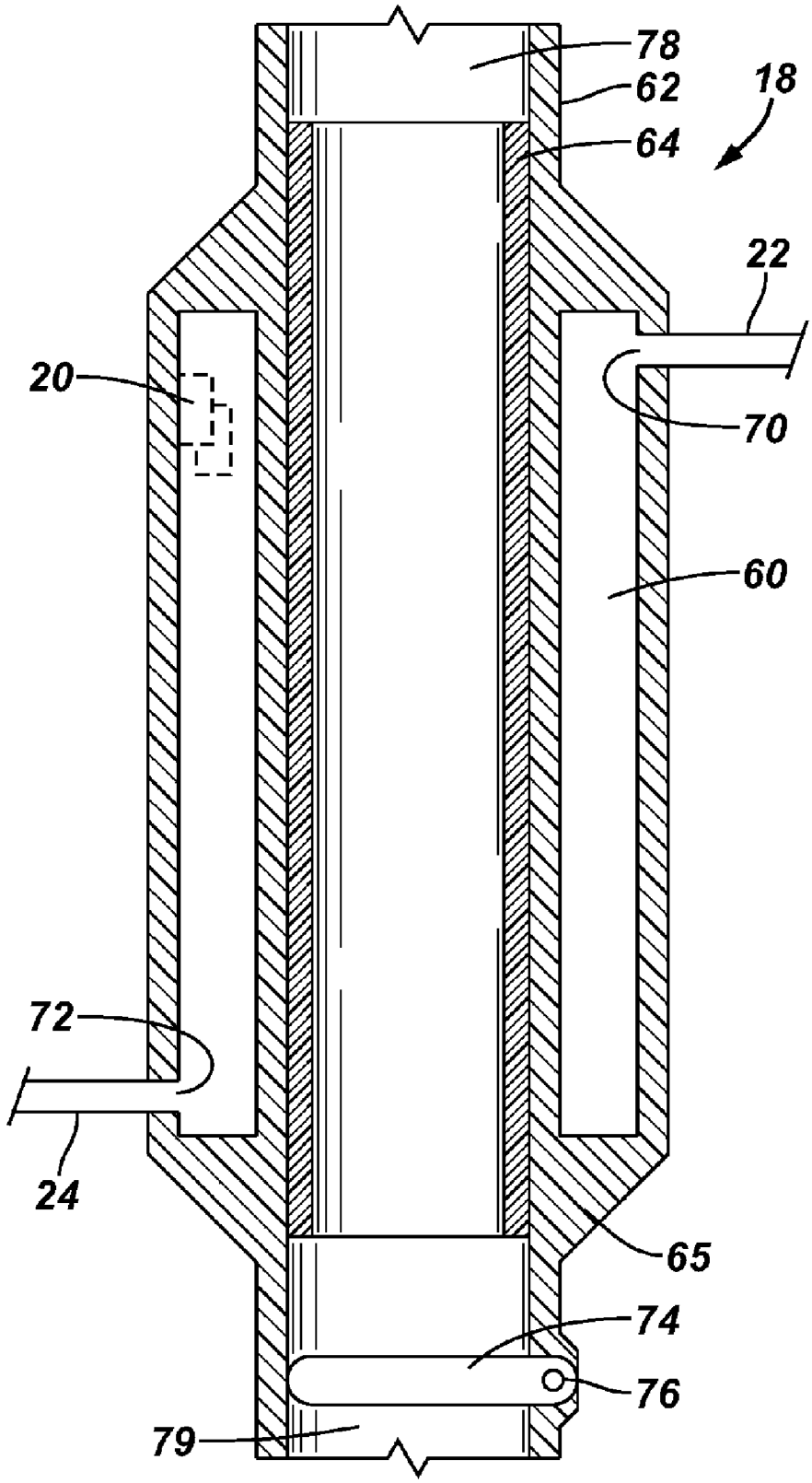
FIGS. 2 and 5 are schematic diagrams of safety valve assemblies according to different embodiments of the invention.

As a more specific example, FIG. 2 depicts a possible embodiment of the safety valve assembly 18. As depicted in FIG. 2, in some embodiments of the invention, the safety valve assembly 18 may be a "flapper valve" assembly, in that the safety valve assembly 18 typically includes a flapper valve closure element 74 to control communication between a central passageway 78 (of the safety valve assembly 18) above the flapper valve element 74 and a central passageway 79 (of the safety valve assembly 18) below the flapper valve element 74. The central passageway 78 and 79 are concentric with the portions of the tubing string 14 immediately above and below the safety valve assembly 18.

In its closed state (the state depicted FIG. 2), the flapper valve element 74 blocks communication between the central passageways 78 and 79. This is the normal state of the safety valve assembly 18 in that in some embodiments of the invention the flapper valve element 74 is biased to remain closed. Although biased to remain closed, the flapper valve element 74 is constructed to pivot about a pivot connection 76 in a counterclockwise direction to open communication between the central passageways 78 and 79 (and thus, open the safety valve assembly 18) when a flow tube 64 (of the safety valve assembly 18) exerts a downward force on the flapper element 74.

More particularly, as described below, to open the safety valve assembly 18, hydraulics of the assembly 18 move the flow tube 64 in a downward direction so that the flow tube 64 pushes the flapper valve element 74 downwardly (and thus, pivots the flapper valve element 74 in a counterclockwise direction about the pivot point 76) to open communication between the central passageways 79 and 78. In some embodiments of the invention, the flow tube 64 may be formed from sections of different diameters so that the flow tube 64 is a telescoping tube.

For purposes of moving the flow tube 64 in a downward direction to open the flapper valve element 74, the safety valve assembly 18 includes a first input control port 70 that is connected to the hydraulic line 22 (to receive the $P_c$ control pressure) and a second input control port 72 that is connected to the hydraulic control line 24 (to receive the $P_b$ balance pressure). The ports 70 and 72 may be extend through a housing 62 (formed from one or more connected pieces) of the safety valve assembly 18.

The difference between the $P_c$ control pressure and the $P_b$ balance pressure controls operation of a flow tube actuator 60 of the safety valve assembly 18. Thus, depending on the relationship between the $P_c$ and $P_b$ pressures, the flow tube actuator 60 either keeps the flow tube 64 in the position depicted in FIG. 2 (to keep the safety valve assembly 18 closed) or moves the flow tube 64 in a downward direction to pivot the flapper valve element 74 (to open the safety valve assembly 18).

As depicted in FIG. 2, in some embodiments of the invention, the safety valve assembly 18 may include the housing 62 that generally houses the flow tube actuator 60 (disposed in a side pocket 65 of the housing 62) as well as the flow tube 64 that is concentric with the central passageway of the housing 62. Furthermore, the pivot point 76 may attached to the housing 62.

As shown in FIG. 2, in some embodiments of the invention, the pressure sensor(s) 20 may be located in a side pocket 65 of the safety valve assembly 18. Thus, in some embodiments of the invention, the pressure sensor(s) 20 may be located in close proximity (within 5 feet, for example) to the valve closure element of the safety valve assembly 18, such as the flapper valve element 74. As depicted in FIG. 2, in some embodiments of the invention, the pressure sensor(s) 20 may be located in the housing 62 near the one or more pistons that drive the flow tube 64 of the safety valve assembly 18. However, the pressure sensor(s) 20 may be located in other parts of the safety valve assembly 18, in other embodiments of the invention. Thus, many variations are possible and are within the scope of the appended claims.

It is noted that other types of safety valves may be used in other embodiments of the invention. For example, although FIG. 2 depicts a flapper-type safety valve assembly, in other embodiments of the invention, a safety valve that uses a ball valve as a valve element may be used. Furthermore, in some embodiments of the invention, the safety valve assembly 18 may include multiple valve elements (multiple flapper valve or ball valve elements, for example) to provide redundancy for the safety valve assembly 18. Thus, many variations are possible and are within the scope of the appended claims.

Figure 3:
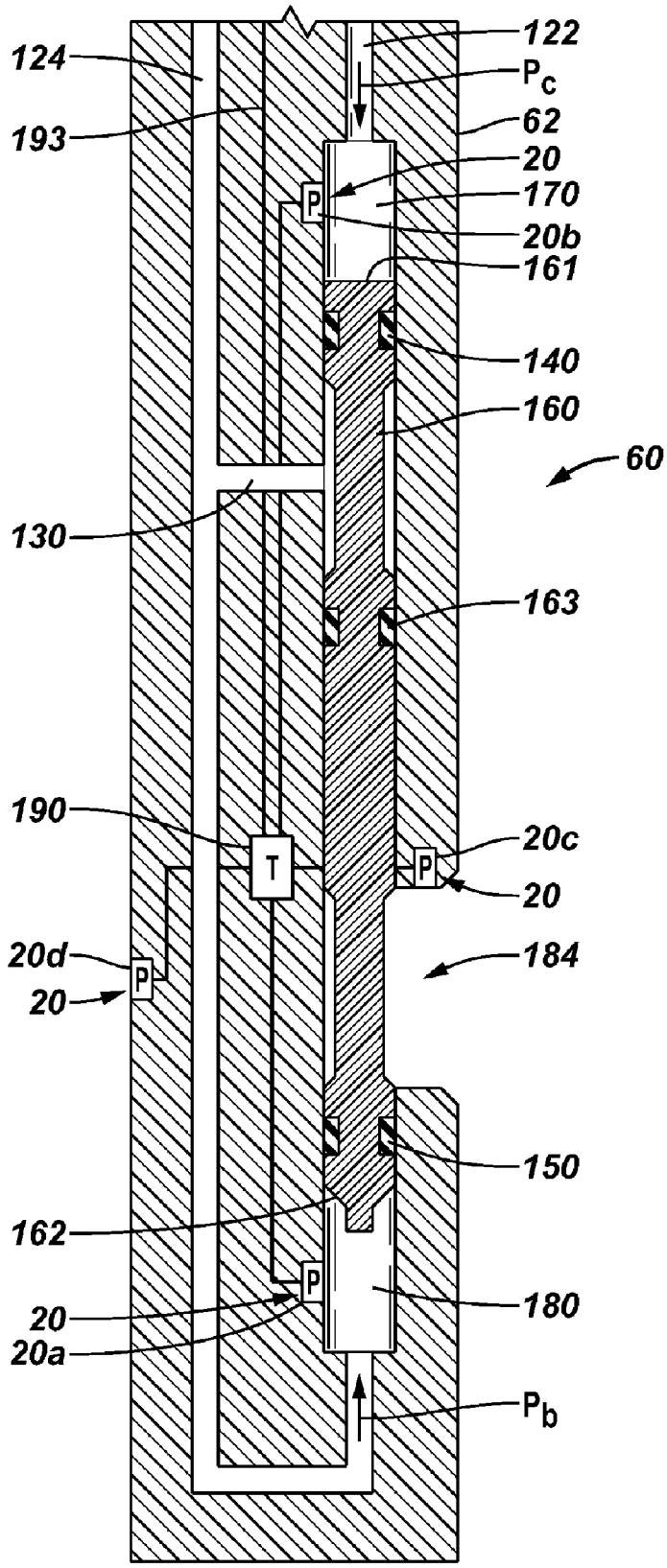
FIG. 3 is a schematic diagram of a flow tube actuator of the safety valve assembly of FIG. 2 according to an embodiment of the invention.

FIG. 3 depicts one out of many possible embodiments for the flow tube actuator 60 in accordance with an embodiment of the invention. Referring to FIG. 3, the flow actuator 60 includes a piston 160 that is attached to the flow tube 64 through a mechanical connection (not shown) through an opening 184 in the housing 62. The piston 160 is constructed to move (and thus, move the flow tube 64) in response to a difference between the $P_c$ control pressure (appearing in a control pressure chamber 170) and the $P_b$ balance pressure (appearing in a balance pressure chamber 180).

More specifically, in some embodiments of the invention, when the $P_c$ control pressure exerts a force (on a top surface 161 of the piston 160) that is greater than the weight of the piston 160 and the force that is exerted by the $P_b$ balance pressure (on the bottom surface 162 of the piston 160), the piston 160 moves in a downward direction to open the flapper valve element 74 (see FIG. 2). Conversely, when the $P_c$ control pressure exerts a force on the piston 160, which is less than the combined weight of the piston 160 and the force that is exerted on the piston 160 by the $P_b$ balance pressure, the piston 160 moves in an upward direction to permit the flapper valve element 74 to close. In some embodiments of the invention, the flow actuator 60 may include a spring and or a gas accumulator acting as a spring (not shown) to exert an upward force on the piston 160 to allow the flapper valve element 74 to close if the forces that are exerted on the piston 160 are otherwise balanced.

As depicted in FIG. 3, in some embodiments of the invention, the flow actuator 60 includes a passageway 122 in the housing 62 to communicate the $P_c$ control pressure to the control pressure chamber 170 and a passageway 124 in the housing 62 to communicate the $P_b$ balance pressure to the balance pressure chamber 180. The flow actuator 60 may also include a failsafe passageway 130 that is in fluid communication with the passageway 124 to control the movement of the piston 60 in the event of a seal failure, as further described below.

In some embodiments of the invention, the flow actuator 60 includes a first seal 140, a second seal 150, and a third seal 163 around the piston 60. The seals 140, 150, 163 isolate the control chamber 170, balance chamber 180 and the central passageway of the production tubing string 14 from each other. The piston 60 is exposed to the central passageway of the string 14 at the opening 184 so that a mechanical connection may be made between piston 60 and the flow tube 64. The opening 184 is positioned between the second seal 150 and the third seal 163. The failsafe passageway 130 is located between the first seal 140 and the third seal 163.

With this particular configuration, if the second seal 150 fails, then fluid from inside the tubing string 14 travels past the second seal 150 and exerts equal and opposite forces on the first and third seals 140 and 163. Furthermore, fluid from inside the tubing string 14 travels directly to the third seal 163 and exerts an upward force on the seal 163 to exert a net upward force on the piston 60. By decreasing the control pressure to $P_c$ that acts on piston 60 at the upper surface 161, the piston 60 moves upward, causing the flapper valve element 34 to close.

If the third seal 163 were to fail, then fluid from the production tubing string 14 travels past the third seal 163, through the failsafe passageway 130 and into the passageway 124 to exert an upward force on the piston 60 via the lower surface 162 by virtue of the second seal 150. Furthermore, fluid from the production tubing string 14 travels past the third seal 163 and exerts an upward force on the first seal 140, thereby exerting a net upward force on the piston 60 to allow valve closure member 30 to close when the $P_c$ control pressure decreases.

If the first seal 140 were to fail, then fluid from the hydraulic control line 22 travels past the first seal 140 and acts equally and oppositely on second and third seals 150 and 163, as would fluid from the hydraulic control line 24. As such, the net forces on piston 60 due to control pressure $P_c$ and balance pressure $P_b$ are zero. In some embodiments of the invention, a spring and or a gas accumulator acting as a spring (not shown) that keeps the flapper valve element 34 closed when the net forces on the piston 60 are otherwise zero lifts the flow tube 64 to close the safety valve assembly 18.

If both first and third seals 140 and 163 were to fail, then fluid from the production tubing string 14 flows through the failsafe passageway 130 and into the passageway 124 to exert an upper force on the piston 60. Fluid from the production tubing string 14 exerts a downward force on the piston 60 against the second seal 150. Furthermore, fluid from the hydraulic control line 24 flows through failsafe passageway 130 and exerts a downward force on the second seal 150, as well as exerts an upward force on second seal 150 in the normal manner through the control line 24. Similarly, fluid from the control line 22 exerts both upward and downward forces on the second seal 150. As such, the net forces due to fluid pressure on the piston 60 are zero and a spring (not shown) lifts the flow tube 64 to close the safety valve assembly 18.

The safety valve assembly 18 is one out of many types of safety valve assemblies that may be used in accordance with embodiments of the invention. Thus, in accordance with the various embodiments of the invention, the safety valve assembly may or may not have the failsafe features that are described herein and may have different failsafe features than those that are described herein. Furthermore, in some embodiments of the invention, the safety valve assembly may not be hydraulically-actuated. Thus, although the safety valve assembly may take on various forms, the safety valve assembly includes at least one pressure sensor. More specific details regarding the basic operation of the safety valve assembly 18 in accordance with the embodiment that is depicted in FIGS. 2 and 3 may be found in U.S. Pat. No. 6,513,594, entitled "Subsurface Safety Valve," issued on Feb. 4, 2003.

As shown in FIG. 3, although pressure sensors may be located anywhere in the safety valve assembly 18, in some embodiments of the invention, one or more pressure sensors 20 may be embedded in the flow actuator 60. For example, in some embodiments of the invention, a pressure sensor 20*a* may be located in the housing 62 near the chamber 180 for purposes of measuring, or sensing, the balance pressure $P_b$. As also depicted in FIG. 3, in some embodiments of the invention, a pressure sensor 20*b* may be located in the housing 62 near the chamber 170 to measure, or sense, the control pressure $P_c$. Likewise, in some embodiments of the invention, a pressure sensor 20*c* may be embedded in the housing 62 near the opening 184 for purposes of sensing, or measuring, pressure inside the tubing string 14 (see FIG. 1).

Lastly, in some embodiments of the invention, a pressure sensor 20*d* may be located in the housing 62 and exposed to the annulus 15 (see FIG. 1) for purposes of sensing, or measuring, annulus pressure. As shown in FIG. 3, in some embodiments of the invention, all of these various pressure sensors 20*a*, 20*b*, 20*c* and 20*d* may electrically communicate with a telemetry circuit 190. The telemetry circuit 190 may communicate with the monitoring circuit 46 (see FIG. 1) via one or more telemetry lines 193 (as an example). Many variations are possible and are within the scope of the appended claims.

Figure 4:
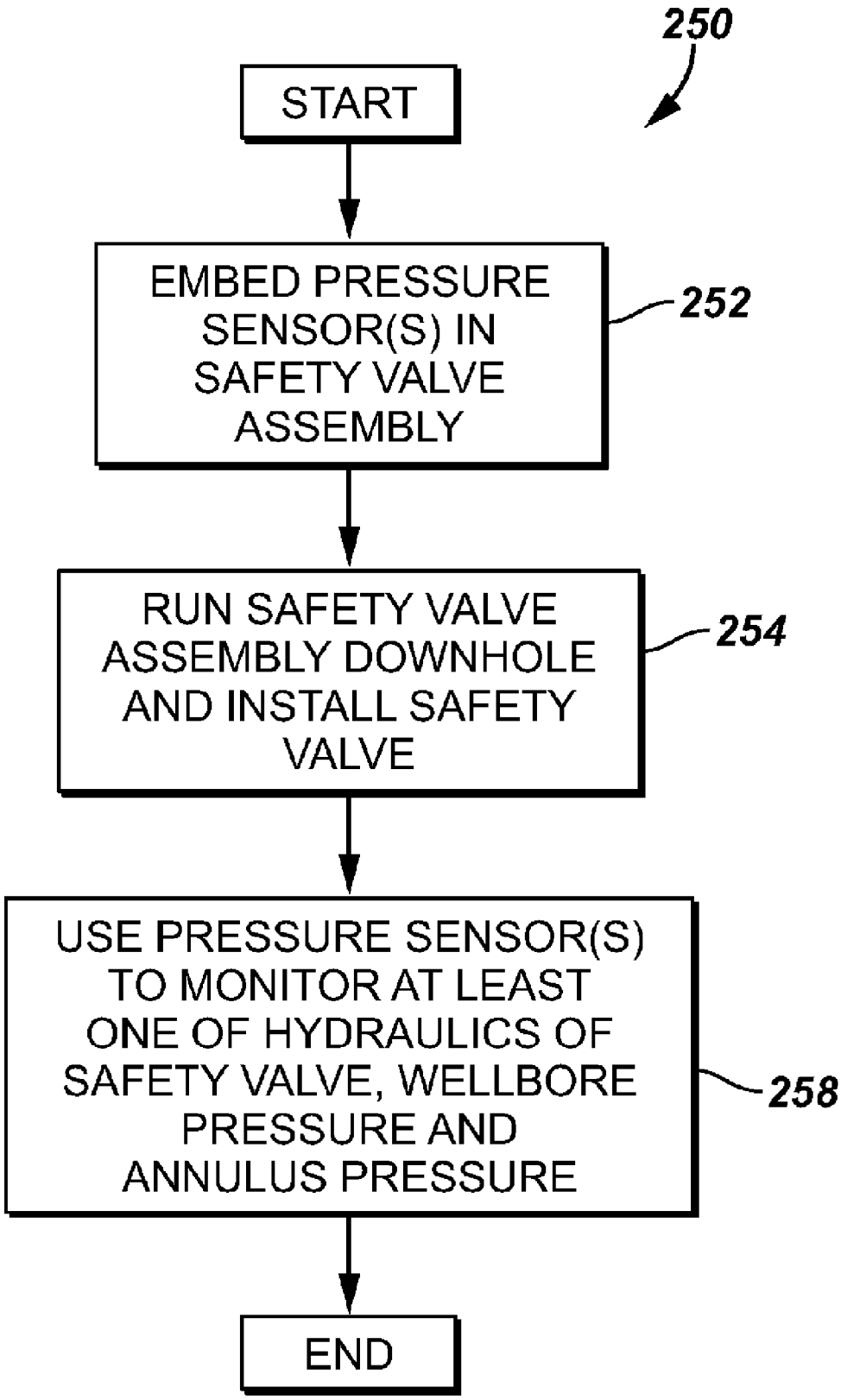
FIG. 4 is a flow diagram depicting a technique according to an embodiment of the invention.

To summarize, in accordance with some embodiments of the invention, a technique 250 that is depicted in FIG. 4 may be used to monitor downhole pressure. Pursuant to the technique 250, one or more pressure sensors are embedded in a safety valve assembly, as depicted in block 252. Pursuant to the technique 250, the safety valve assembly is then run downhole and installed, as depicted in block 254. The pressure sensor(s) are used (block 258) to monitor at least one of the pressure of hydraulics of a safety valve, pressure inside a tubular string pressure and annulus pressure. Other variations are possible and are within the scope of the appended claims.

Figure 5:
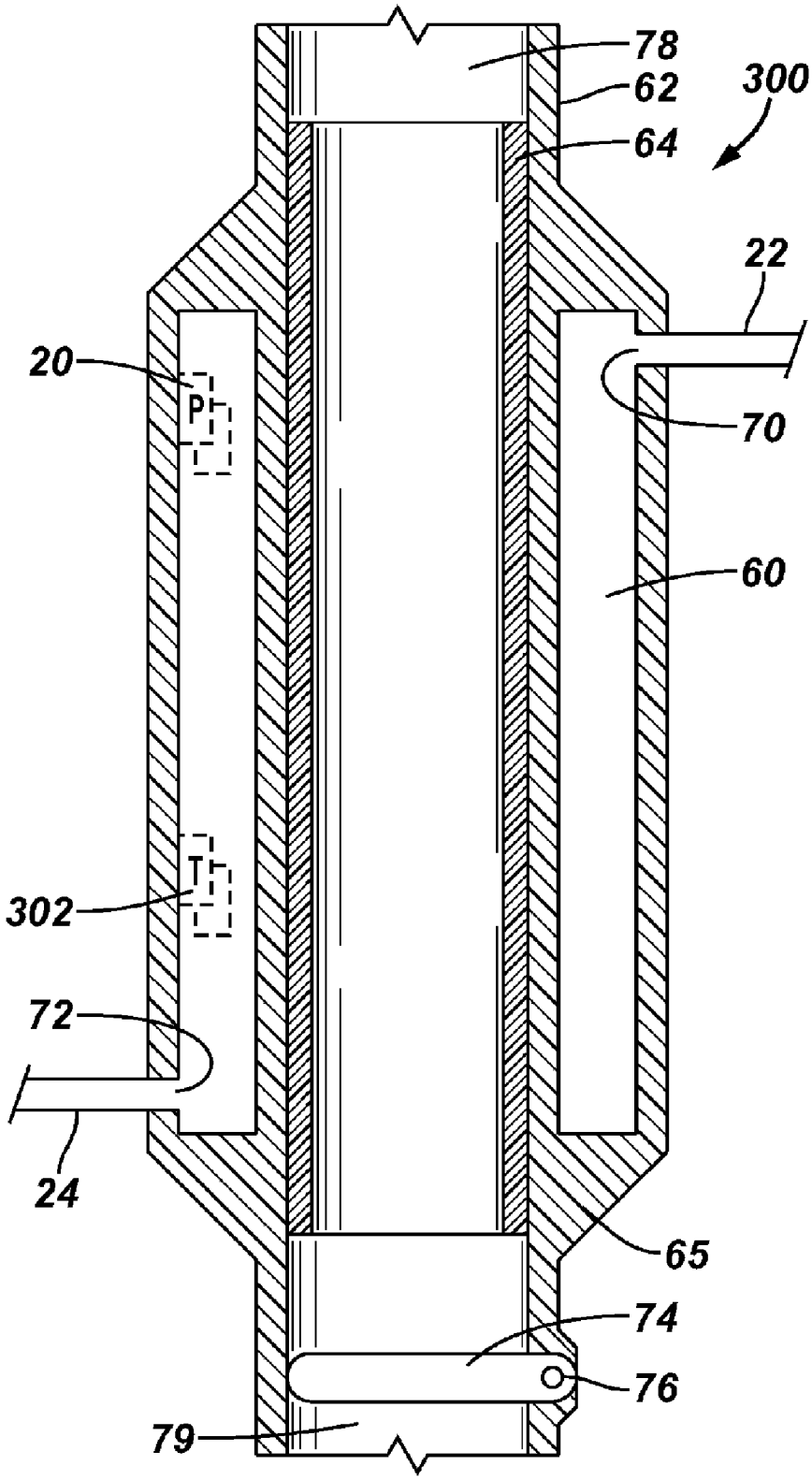

Sensors other than pressure sensors may be used in other embodiments of the invention. For example, referring to FIG. 5, in accordance with some embodiments of the invention, a safety valve assembly 300 has a similar design to the safety valve assembly 18 (see FIG. 2, for example), with the exception that the safety valve assembly 300 includes one or more temperature sensors 302. The temperature sensor(s) 302 may be located in various locations (i.e., control line, annulus and tubing temperatures) inside the safety valve assembly 300, such as the pressure sensor locations (for example) that are described above. Furthermore, the temperature sensor(s) 302 may be in other locations to measure well fluid and hydraulic fluids (for example) within the well. The telemetry circuit 190 (FIG. 3) may be used to communicate measured temperature(s) from the temperature sensors 302 to the monitoring circuit 46 (FIG. 1) at the surface of the well.

Thus, depending on the particular embodiment of the invention, the safety valve assembly may include a combination of one or more pressure sensors and one or more temperature sensors; may include only one or more pressure sensors (and no temperature sensors); or may include only one or more temperature sensors (and no pressure sensors). Therefore, many variations are possible and are within the scope of the appended claims. It is noted that with the ability to measure temperature at the depth of the safety valve assembly, the operator at the surface of the well is provided with additional data to further "know-the-well" at this well depth.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a subterranean well, comprising:

a safety valve assembly controllable to selectively isolate a formation of a well from the surface of the well;

a first control line and a second control line coupled to the safety valve assembly and extending to the surface of the well, wherein the safety valve assembly is moved to an open position via hydraulic input through the first control line into a closed position via hydraulic input through the second control line; and a pressure sensor located in the safety valve assembly to measure a pressure near the safety valve assembly.

2. The apparatus of claim 1, wherein the safety valve assembly comprises a flapper valve assembly.

3. The apparatus of claim 1, wherein the safety valve assembly comprises a valve closure element, and the pressure sensor is located near the valve closure element.

4. The apparatus of claim 3, wherein the pressure sensor is located within five feet of the valve closure element.

5. The apparatus of claim 3, wherein the safety valve assembly comprises a housing that houses the valve closure element and the pressure sensor.

6. The apparatus of claim 1, wherein the safety valve assembly is adapted to be deployed over 5,000 feet downhole.

7. The apparatus of claim 1, wherein the safety valve assembly comprises:

a valve closure element adapted to be controlled by pressure in at least one of the first and second control lines.

8. The apparatus of claim 7, wherein the pressure sensor is adapted to measure pressure in at least one of the first and second control lines.

9. The apparatus of claim 1, wherein the pressure sensor is adapted to measure at least one of the following:

a pressure in a tubing string and an annulus pressure.

10. The apparatus of claim 1, further comprising:

a circuit to communicate an indication of the measured pressure to the surface of the well.

11. The apparatus of claim 1, wherein the pressure sensor is one of a plurality of pressure sensors in the safety valve.

12. The apparatus of claim 11, wherein the plurality of pressure sensors measure at least an annulus pressure and a pressure in a control line extending from the surface of the well to the safety valve assembly.

13. A safety valve assembly usable with a subterranean well, comprising:

a housing;

a flapper located in the housing to selectively isolate a formation of the well from the surface of the well;

a flow tube;

an actuator to control movement of the flow tube to move the flapper to selectively open the valve and close the valve, the movement of the flapper to close the valve being controlled by application of hydraulic pressure in a first direction and the movement of the flapper to open the valve being controlled by application of hydraulic pressure in a second direction, wherein the hydraulic pressure is applied from the surface of the well; and a pressure sensor located in the housing to measure a pressure.

14. The safety valve assembly of claim 13, wherein the housing is adapted to be detachable from a tubular string extending into the well.

15. The safety valve assembly of claim 13, wherein the pressure sensor is located within five feet of the flapper.

16. The safety valve assembly of claim 13, wherein the safety valve assembly is adapted to be deployed over 5,000 feet downhole.

17. The safety valve assembly of claim 13, wherein the hydraulic pressure is applied in at least one hydraulic line.

18. The safety valve assembly of claim 17, wherein the pressure sensor is adapted to measure pressure in at least one hydraulic line.

19. The safety valve assembly of claim 13, wherein the pressure sensor is adapted to measure at least one of the following:

a pressure in a tubing string and an annulus pressure.

20. The safety valve assembly of claim 13, wherein the pressure sensor is one of a plurality of pressure sensors in the safety valve.

21. The safety valve assembly of claim 20, wherein the plurality of pressure sensors measure at least an annulus pressure and a pressure in a control line extending from the surface of the well to the safety valve apparatus.

22. A method usable with a subterranean well, comprising:

running a safety valve assembly downhole;

running a pressure sensor downhole with the safety valve assembly to measure a pressure near the safety valve assembly; and using the pressure sensor to measure pressure in at least one hydraulic line used to control the safety valve assembly.

23. The method of claim 22, wherein the act of running the safety valve assembly comprises running a flapper valve assembly downhole.

24. The method of claim 22, wherein further comprising locating the pressure sensor near a valve closure element of the safety valve assembly.

25. The method of claim 22, further comprising:

after the act of running the pressure sensor downhole, communicating with the pressure sensor from the surface of the well.

26. The method of claim 22, further comprising:

integrating the pressure sensor with the safety valve assembly so that the safety valve assembly is located within five feet of a valve closure element of the safety valve assembly.

27. The method of claim 22, wherein the act of running the safety valve assembly downhole comprises running the safety valve assembly at least 5,000 feet downhole.

28. The method of claim 22, further comprising: using the pressure sensor to measure at least one of a pressure in a tubing string and an annulus pressure.

29. The method of claim 22, wherein the pressure sensor is one of a plurality of pressure sensors located in the safety valve assembly.

30. The method of claim 29, further comprising:

using the plurality of pressure sensors to measure at least an annulus pressure and a pressure in a control line extending from the surface of the well to the safety valve assembly.

31. An apparatus usable with a subterranean well, comprising:

a safety valve assembly i-s controllable to selectively isolate a formation of a well from the surface of the well;

a first control line and a second control line coupled to the safety valve assembly and extending to the surface of the well, wherein the safety valve assembly is moved to an open position via hydraulic input through the first control line into a closed position via hydraulic input through the second control line; and a temperature sensor located in the safety valve assembly to measure a temperature near the safety valve assembly.

32. The apparatus of claim 31, wherein the safety valve assembly comprises a flapper valve assembly.

33. The apparatus of claim 31, wherein the safety valve assembly comprises a valve closure element, and the temperature sensor is located near the valve closure element.

34. The apparatus of claim 33, wherein the temperature sensor is located within five feet of the valve closure element.

35. The apparatus of claim 33, wherein the safety valve assembly comprises a housing that houses the valve closure element and the temperature sensor.

36. The apparatus of claim 31, wherein the safety valve assembly is adapted to be deployed over 5,000 feet downhole.

37. The apparatus of claim 31, wherein the safety valve assembly comprises:

a valve closure element adapted to be controlled by temperature in at least one of the first and second control lines.

38. The apparatus of claim 37, wherein the temperature sensor is adapted to measure temperature in at least one of the first and second control lines.

39. The apparatus of claim 31, wherein the temperature sensor is adapted to measure at least one of the following:

a temperature in a tubing string and an annulus temperature.

40. The apparatus of claim 31, further comprising:

a circuit to communicate an indication of the measured temperature to the surface of the well.

41. The apparatus of claim 31, wherein the temperature sensor is one of a plurality of temperature sensors in the safety valve assembly.

42. The apparatus of claim 41, wherein the plurality of temperature sensors measure at least an annulus temperature and a temperature in a control line extending from the surface of the well to the safety valve assembly.

43. A safety valve assembly usable with a subterranean well, comprising:

a housing;

a flapper located in the housing to selectively isolate a formation of the well from the surface of the well;

a flow tube;

an actuator to control movement of the flow tube to move the flapper to selectively open the valve and close the valve, the movement of the flapper to close the valve being controlled by application of hydraulic pressure in a first direction and the movement of the flapper to open the valve being controlled by application of hydraulic pressure in a second direction, wherein the hydraulic pressure is applied from the surface of the well; and a temperature sensor located in the housing to measure a temperature.

44. The safety valve assembly of claim 43, wherein the housing is adapted to be detachable from a tubular string extending into the well.

45. The safety valve assembly of claim 43, wherein the temperature sensor is located within five feet of the flapper.

46. The safety valve assembly of claim 43, wherein the safety valve assembly is adapted to be deployed over 5,000 feet downhole.

47. The safety valve assembly of claim 43, wherein the hydraulic pressure is applied in at least one hydraulic line.

48. The safety valve assembly of claim 47, wherein the temperature sensor is adapted to measure temperature in at least one hydraulic line.

49. The safety valve assembly of claim 43, wherein the temperature sensor is adapted to measure at least one of the following:

a temperature in a tubing string and an annulus temperature.

50. The safety valve assembly of claim 43, wherein the temperature sensor is one of a plurality of temperature sensors in the safety valve.

51. The safety valve assembly of claim 50, wherein the plurality of temperature sensors measure at least an annulus temperature and a temperature in a control line extending from the surface of the well to the safety valve apparatus.

52. A method usable with a subterranean well, comprising:

running a safety valve assembly downhole;

running a temperature sensor downhole with the safety valve assembly to measure a temperature near the safety valve assembly; and controlling actuation of the safety valve assembly via hydraulic inputs provided from a surface location.

53. The method of claim 52, wherein the act of running the safety valve assembly comprises running a flapper valve assembly downhole.

54. The method of claim 52, wherein further comprising locating the temperature sensor near a valve closure element of the safety valve assembly.

55. The method of claim 52, further comprising:

after the act of running the temperature sensor downhole, communicating with the temperature sensor from the surface of the well.

56. The method of claim 52, further comprising:

integrating the temperature sensor with the safety valve assembly so that the safety valve assembly is located within five feet of a valve closure element of the safety valve assembly.

57. The method of claim 52, wherein the act of running the safety valve assembly downhole comprises running the safety valve assembly at least 5,000 feet downhole.

58. The method of claim 52, further comprising:

using the temperature sensor to measure temperature in at least one hydraulic line used to control the safety valve assembly.

59. The method of claim 52, further comprising:

using the temperature sensor to measure at least one of a temperature in a tubing string and an annulus temperature.

60. The method of claim 52, wherein the temperature sensor is one of a plurality of temperature sensors located in the safety valve assembly.

61. The method of claim 60, further comprising:

using the plurality of temperature sensors to measure at least an annulus temperature and a temperature in a control line extending from the surface of the well to the safety valve assembly.

* * * * *